United States Patent [19]

Hensley

[11] 4,354,553

[45] Oct. 19, 1982

[54] CORROSION CONTROL DOWNHOLE IN A BOREHOLE

[76] Inventor: Clifford J. Hensley, 310 W. Illinois, Suite 315, Midland, Tex. 79701

[21] Appl. No.: 196,677

[22] Filed: Oct. 14, 1980

[51] Int. Cl.[3] ..... E21B 43/12; E21B 43/40; E21B 47/00

[52] U.S. Cl. ..... 166/244 C; 166/64; 166/250; 166/267; 166/310

[58] Field of Search ..... 166/53, 64, 75 R, 113, 166/244 C, 250, 267, 310; 73/151

[56] References Cited

U.S. PATENT DOCUMENTS

| | | | |
|---|---|---|---|
| 2,089,035 | 8/1937 | Oberlin | 166/310 |
| 3,171,485 | 3/1965 | White, Jr. | 166/310 X |
| 3,298,438 | 1/1967 | Anthony et al. | 166/250 X |
| 3,710,867 | 1/1971 | Bansbach | 166/244 C |
| 3,901,313 | 8/1975 | Doniguian et al. | 166/244 C X |
| 4,064,936 | 12/1977 | McClure | 166/75 R |
| 4,132,268 | 1/1979 | Harrison | 166/244 C |

FOREIGN PATENT DOCUMENTS

| | | | |
|---|---|---|---|
| 865512 | 3/1971 | Canada | 166/64 |

*Primary Examiner*—James A. Leppink

*Assistant Examiner*—George A. Suchfield

*Attorney, Agent, or Firm*—Marcus L. Bates

[57] ABSTRACT

Well treatment method and apparatus for chemically inhibiting downhole production equipment with corrosion inhibitors. Water is separated from the produced well fluid, and the flow rate and corrosive properties of the separated water is measured. Inhibitor solution is then injected into the stream of water in an amount which is proportional to the corrosive measurement of the water, thereby providing the exact amount of chemical treatment required to avoid downhole corrosion. The inhibitor and the water are intimately mixed, and the mixture is flowed into the casing annulus. The conductivity of the produced fluid is measured, and the measurement is used to adjust the rate of flow of the separated water to a value which assures that the mixture of water and inhibitor flow down through the hydrocarbons contained in the casing annulus. This enables the inhibitor and water mixture to fall through the hydrocarbons contained in the well annulus and arrive at the casing perforations during an interval of time which is less than the time lapse required for the inhibitor to leave the mixture and become admixed with the hydrocarbons contained within the annulus.

17 Claims, 3 Drawing Figures

RATE OF CORROSION
Wt % CHEMICAL TREATMENT
92
96
94
98

TO FLOW LINE
30
$H_2O$+OIL
$H_2O$
28
26
34
32
166
66
64
18
14
70
68
90
60
62
48
50
54
52
FROM BULK-INHIBITOR STORAGE
FROM BULK-SCALE INHIBITOR (OPTION I)
38
40
88
24
80
82
86
75
76
78
84
74
72

CORROSION CONTROL DOWNHOLE IN A BOREHOLE

BACKGROUND OF THE INVENTION

Most oilwells produce both hydrocarbons and water. The oilwell production fluid is usually highly corrosive. This is especially so in waterflood oilfields. Sometimes the corrosion problems are so great that a workover rig must pull the oilwell pumping unit and replace the pump and sucker rods every few weeks. This is quite expensive and unless a substantial production of hydrocarbons is realized from the well, the economics of many wells in a waterflood region becomes questionable, unless the problem of corrosion can be economically reconciled.

In many regions, it is popular to partially combat downhole well corrosion by introducing a treatment chemical, such as an inhibitor, into the annulus of the wellbore. The treatment chemical usually is admixed with water and pumped into the casing annulus at a rate of perhaps one treatment per week. This batch, or truck type, treatment provides an immediate high concentration of inhibitor in the wellbore, but the effectiveness of the treatment chemical rapidly tapers off until there is insignificant treatment available during the last few days of the cyclic treating time period.

Others have continually introduced treatment chemicals into the annulus, but this expedient does not always satisfactorily control the corrosion problem downhole in the borehole for the reason that the chemical preferentially migrates into the upper fluid column of the annulus where it remains in the hydrocarbon phase and therefore does not properly treat all of the metal components of the lower borehole.

The above prior art treatments generally require an excessive amount of inhibitor chemical which hardly ever is ideally placed in the proper area of the borehole to enable satisfactory protection from corrosion to be achieved.

It would be desirable to introduce a continuous stream of proper and effective treatment chemical into the annulus of a borehole, and to cause the treatment chemical to migrate down through the upper phase of the annular fluid and downhole to the casing perforations, where the treatment chemical becomes comingled with the production fluid and is returned up the tubing string to the surface of the earth, thereby properly coating all of the downhole metal components with the optimum amount of inhibitor required to control the downhole corrosion problems. Process and apparatus which obtains this desirable goal is the subject of the present invention.

| | | | |
|---|---|---|---|
| Rodger, et al | 2,688,368 | Hampton | 3,223,167 |
| Rohrback | 2,801,697 | Bansbach | 3,710,867 |
| McNamra | 2,843,206 | Harrison | 4,132,268 |
| Marken | 2,884,067 | | |

The above references show that continuous downhole treatment of a wellbore is old, and that some of the produced fluid admixed with treatment chemical can be continuously circulated back to the well. The prior art fails to suggest the concept of using a specific flow rate of separated water admixed with a specific quantity of treatment chemical to achieve propagation of the mixture down through the annular fluid column to the bottom of the borehole, nor does the prior art suggest apparatus for carrying out this concept.

SUMMARY OF THE INVENTION

Method and apparatus by which a hydrocarbon producing wellbore is continuously treated with treatment chemical to thereby control corrosion and the problems associated therewith downhole in the borehole.

An optimum quantity of treatment chemical is admixed with a finite quantity of water, and the mixture is flowed into the upper column of the annular fluid contained between the casing and the production tubing. The mixture migrates or gravitates down through the hydrocarbons contained within the annular fluid column at a rate which causes the mixture to arrive at the casing perforation and comingle with the production fluid from the formation in a time interval which is shorter than the time interval required for the treatment chemical to separate from the water carrier and comingle with the upper annular fluid column. This time interval usually is approximately six to twelve hours.

The mixture is produced along with the formation fluid, which travels back up through the production tubing and to the surface where the flowing fluids are analyzed to determine the effectiveness of the treatment and the length of time required for the treatment chemical to travel from the mixing pump, downhole into the borehole, down through the fluid column, and back up to the surface of the ground. This data is utilized to adjust the flow rate of the mixture to the optimum value to achieve the above.

In most wells, especially in waterflood zones, water is produced along with the hydrocarbons from the formation, with the water and hydrocarbons comingling as the fluid is pumped to the surface of the earth. In the present disclosure, at least a portion of the produced water is separated from the produced hydrocarbons, and the separated water fraction is used in conjunction with the treatment chemical to provide the aforesaid mixture. The separated water is analyzed to determine its instantaneous corrosion rate, and this measurement is used to control the rate at which the treatment chemical is continuously injected into the separated water to provide the proper concentration of inhibitor contained within the mixture.

Accordingly, the present disclosure teaches flowing a mixture of treatment chemical and separated well water into a borehole annulus at a rate which causes the mixture to arrive downhole in the borehole as a substantially unseparated mixture, whereupon the treatment chemical coats all of the downhole metal parts of the well which are subjected to the deleterious effects of corrosion. The formation fluids comingle with the mixture and is produced therewith back up through the tubing string to the surface of the ground, where the fluids are analyzed, passed through a separator, and then to a tank battery, while at least part of the separated water is analyzed, admixed with treatment chemical, and returned into the well annulus. The returned water is analyzed to determine the time interval for the mixture to gravitate through the annular fluid column, and this measurement is used to adjust the continuous injection rate of the mixture into the wellbore.

Accordingly, a primary object of the present invention is the provision of a testing procedure by which the injection rate of treatment chemical can be controlled to provide the precise amount of protection required downhole in a borehole.

Another object of the present invention is the provision of a well treatment process which uses an inhibitor for controlling corrosion; and, wherein the inhibitor is disbursed in water, translocated into the wellbore annulus at a rate which forces the inhibitor and water mixture to gravitate down the fluid column where the inhibitor then breaks out of the mixture, becomes disbursed within the produced fluid at the perforations, and continuously coats all of the downhole components of the wellbore.

A further object of this invention is the provision of apparatus by which a producing well is protected against corrosion by analyzing the production fluid from a wellbore to determine the quantity of inhibitor therein, separating water from the tested production fluid, testing the instantaneous corrosion rate of the separated water, continuously admixing a supply of inhibitor with the separated water, and flowing the mixture into the borehole annulus so that the mixture gravitates down through the hydrocarbon fluid contained within the borehole annulus at a rate which causes the mixture to arrive at the bottom of the borehole before an appreciable quantity of inhibitor has separated from the mixture.

A still further object of this invention is the provision of method and apparatus for coating the downhole components of an oilwell with treatment chemical comprising admixing an inhibitor chemical with a carrier, flowing the carrier down through the annular fluid column of the well at a rate which causes most of the treatment chemical to arrive at the perforations before it leaves the water, whereupon the inhibitor coats the various components of the lower borehole as the mixture flows down to the wellbore perforations. The residual components of the mixture is produced along with the formation fluids back to the surface of the earth, where the fluids are analyzed to determine the effectiveness of the treatment, and to furthermore determine the time interval required for the mixture to migrate down through the fluid column to the perforations and back up through the production tubing to the surface of the earth.

These and other objects and advantages of the invention will become readily apparent to those skilled in the art upon reading the following detailed description and claims and by referring to the accompanying drawings.

The above objects are attained in accordance with the present invention by the provision of a method for use with apparatus fabricated in a manner substantially as described in the above abstract and summary.

DETAILED DESCRIPTION OF THE PREFERRED EMBODIMENTS

Figure 1:
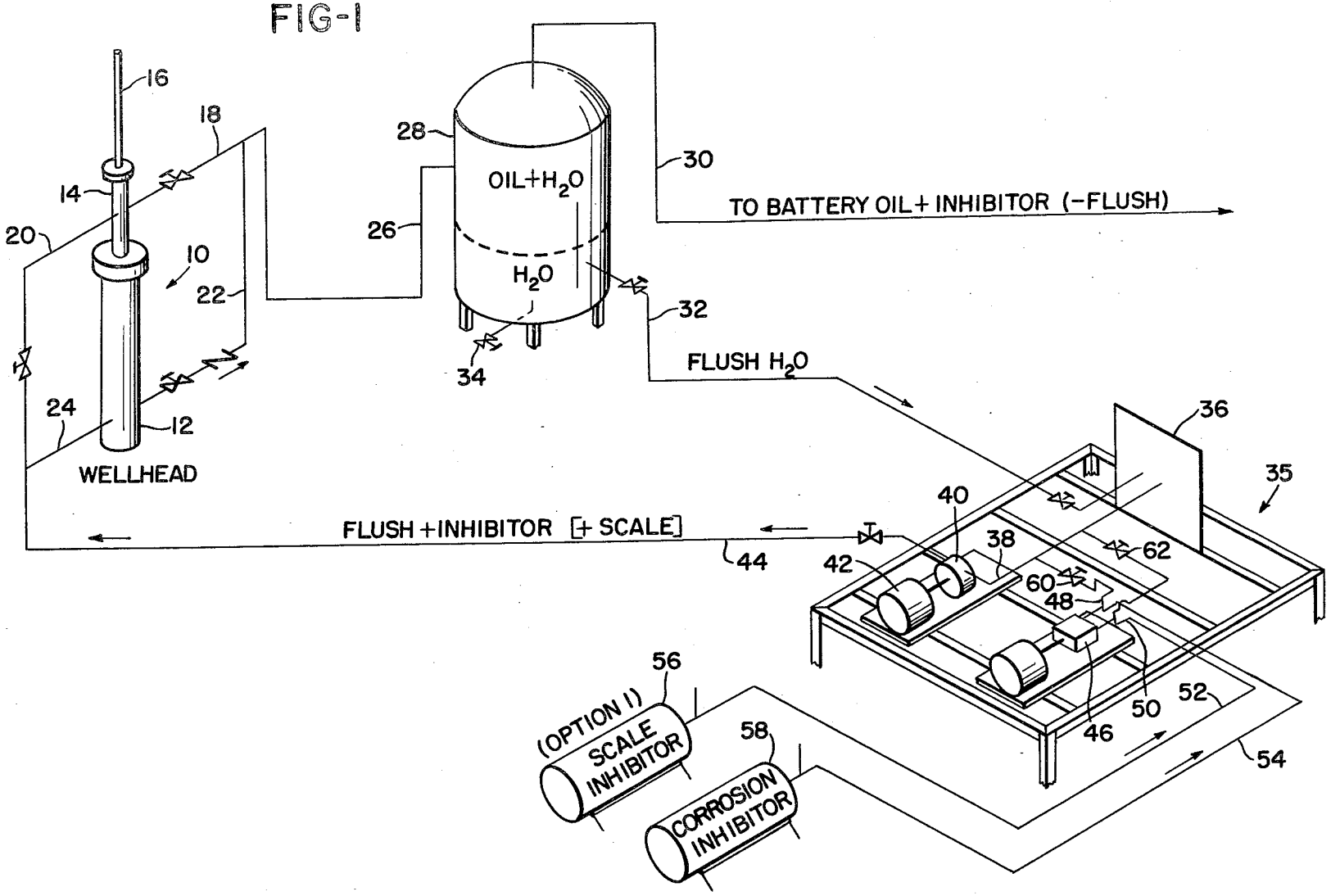
FIG. 1 is a part diagrammatical, part schematical flow sheet which sets forth the present invention.
Figures 2, 3:
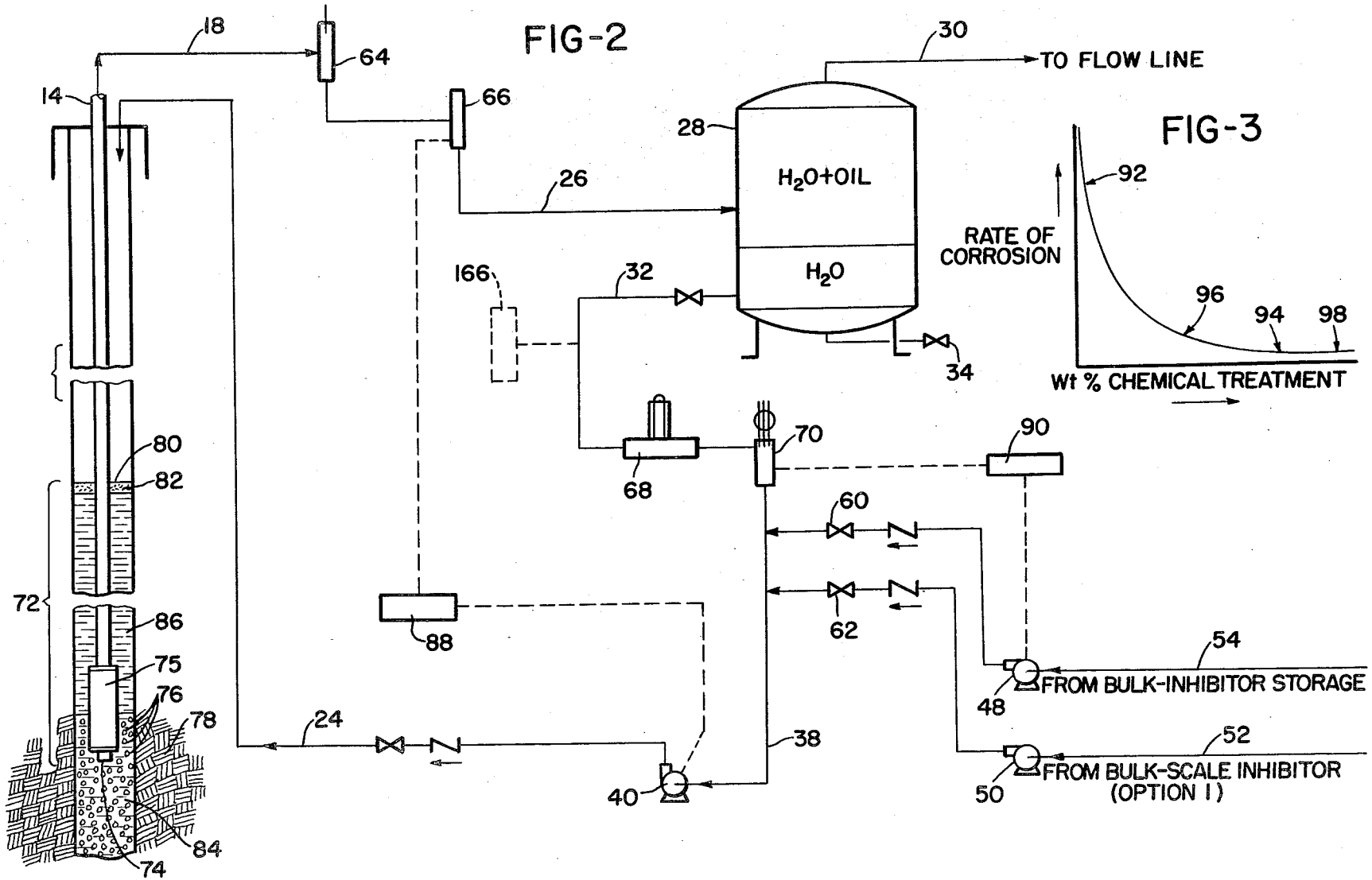
FIG. 2 is a part diagrammatical, part schematical, part cross-sectional representation of a borehole having the apparatus of the present invention associated therewith; and, FIG. 3 is a plot of corrosion rate versus the weight percentage of chemical treatment, as may be associated with downhole conditions in a borehole.

In the various figures of the drawings, and in particular FIGS. 1 and 2, wherein like or similar numerals refer to like or similar elements, there is disclosed a hydrocarbon producing well having the usual wellhead 10, casing 12, and production tubing 14. The well is illustrated as having a sucker rod string connected to the usual polish rod 16, although other types of downhole pumps may be employed in conjunction with the present invention. The well could be a free-flowing well which utilizes the pressure of the reservoir for lifting hydrocarbons to the surface of the earth.

Flow lines 18 and 20 are connected to the tubing string, while flow lines 22 and 24 are connected to the casing so that flow can occur from the production tubing, and flow can occur to and from the borehole annulus formed between the tubing and casing. Appropriate valves are interposed within the various different cited flow lines. Flow line 26 connects a water separator 28 to the tubing of the well. Oil and water flow from the separator to a tank battery (not shown) by means of conduit 30.

At least a portion of the separated water phase flows from the separator at 32 for use in conjunction with the present invention. A drain 34 enables BS&W to be removed from the separator.

Apparatus 35, made in accordance with the present invention, including a control panel 36 upon which various different instruments can be mounted, as will be more particularly discussed in greater detail later on in this disclosure. Flow line 38 is connected from the instruments of the panel to a mixing pump 40. The pump can be an ordinary gear pump having a prime mover 42 such as an electric motor. The gear pump outlet is connected by flow line 44 back to the wellhead inlet 24.

A positive displacement pump 46 includes independent cylinders and pistons 48 and 50, respectively, which independently move fluids from flow lines 52 and 54, respectively. The flow lines are connected to different treatment fluids 56 and 58, respectively. Treatment fluid 56 preferably is scale inhibitor, while treatment fluid 58 preferably is corrosion inhibitor.

Valves 60 and 62, respectively, interconnect the pump cylinders 48 and 50 to the flow lines 38 which in turn is connected to the inlet side of mixing pump 40.

In FIG. 2, there is diagrammatically illustrated a corrosometer 64, a fincher probe 66, a rotormeter 68, and a P.A.I.R. 70. The instruments 64–70 preferably are mounted on the before mentioned instrument panel 36, so that the entire apparatus 35 can be made portable and moved from one to another well, although all of the apparatus as seen in FIG. 2 can be permanently mounted at the well site if such an expedient is deemed desirable.

As particularly illustrated in FIG. 2, the before mentioned wellbore includes the usual hydrostatic head 72 located above inlet 74 of pump 75. Inlet 74 is also referred to herein as the lower end or the inlet end of the tubing string. The inlet 74 is located in proximity of a plurality of perforations 76 formed through the wall of the casing, and which extends back into a hydrocarbon producing formation 78.

The fluid level 80 defines the top of the fluid column located in the borehole annulus. The fluid column is continuously provided with a treatment chemical or mixture 82 in the form of water and inhibitor which have been intimately mixed together. The produced formation fluid is comprised of a mixture of hydrocarbons and water and is denoted by numeral 84. The hydrocarbon fraction of the production fluid separates from the water phase to provide a hydrocarbon column of fluid 86, also called the hydrostatic head.

Numeral 88 schematically indicates a controller means which receives a signal at 66 and controls the output or speed of the mixing pump 40 in proportion thereto so that the flow rate at 38 and 24 is proportional to the signal provided at 66.

Numeral 90 is likewise a controller means which receives a signal generated at 70 and controls the rate of injection of the inhibitor pump 48.

The dot-dash controller means 166 connected to line 32 indicates that the fincher probe 66 can be located in conduit 32 rather than in conduit 26 if deemed desirable.

In FIG. 3, there is illustrated a curve which results from plotting rate of corrosion downhole in the illustrated borehole versus the weight percent of chemical treatment injected by pump 48. Numeral 92 indicates a high rate of corrosion as the treatment chemical is reduced towards zero, while numeral 94 indicates that an extremely low rate of corrosion is present as the weight percent of the treatment chemical is increased. It will be noted that additional inhibitor added at 94 has little or no effect upon the corrosion rate of the system.

Throughout this disclosure, the term "controlling the corrosion rate" is intended to mean the provision of treatment chemical on a continuous basis which results in the components of the borehole having been treated to obtain a condition whereby the rate of corrosion has been reduced to a value indicated by the horizontal portion of the curve of FIG. 3 as indicated by numeral 94. The rate of corrosion could be controlled by reducing the quantity of inhibitor to a point on the curve seen at 96, and if the components of the borehole are protected against corrosion so as to sustain the useful life of the downhole equipment for a satisfactory length of time, this condition would also be considered controlling the rate of corrosion downhole in a borehole. However, when the rate of corrosion is extremely high, as indicated by numeral 92, such that the tubing and downhole pump must be pulled and replaced every few weeks, such a condition is not a satisfactory control of the downhole corrosion rate.

Accordingly, those skilled in the art will appreciate that corrosion in some wells is never eliminated, but that it is controlled at some satisfactory rate, as for example, a rate which lies between numerals 94 and 96 of FIG. 3, so that economical production of an otherwise problem well can be enjoyed.

The addition of excessive inhibitor at 98 will control corrosion downhole in a borehole; however, the lower right hand portion of the curve beyond numeral 98 is believed to be an assymtope, and represents a futile waste of inhibitor. The present invention preferably controls the corrosion rate at a value such as seen at 94, whereby slightly less or slightly more chemical added to the system has very little effect on the corrosion rate, and thereby represents a point on the curve which is the ideal amount of treatment chemical added to the borehole consistent with rate of corrosion and price of the chemical, which assures a reasonable life of the downhole components of the well.

EXAMPLE 1

The borehole of FIGS. 1 or 2 is in a water flood area. The well is on a pumpjack and produces 300 barrels of 95% water cut fluid per day. Treatment chemical of the borehole heretofore comprises the arrival of a treatment truck twice a week whereupon 3 gallons of inhibitor and 500 gallons of fresh water are pumped down the annulus 12. Although the well receives periodic treatment, corrosion problems cause the well to be shut-in each seven weeks and several sucker rods and the pump replaced. The profit from the well is marginal, there being only 15 barrels of hydrocarbons flowed through line 30 to the tank battery (not shown) each day.

A portable unit 35 is set up adjacent to the well and the flow lines connected as illustrated in FIG. 1. Instruments 64, 66, 68 and 70 are connected in the illustrated manner of FIG. 2. Controller means 88 and 90, in this instance, are fulfilled by the technician who manually adjusts the gear pump 40 and the positive displacement pump 48 to achieve the final desired flow rates.

Inhibitor from 54 is continuously metered by the positive displacement pump 48 into flow line 38. At the same time, the flow rate of separated well water is observed at 68. The treatment chemical is admixed with the water by means of the gear pump 40, and commences to flow down the well annulus so that the mixture is translocated to the top of the fluid column 86 as indicated by numeral 82. At the same time, the technician assures that the time is recorded.

The mixture gravitates through the column of hydrocarbons 86, comingles with the formation fluid at 84, and is produced back up through the production tubing 14, flow line 18, where the produced fluids flow through instruments 64 and 66, and into the separator. Most of the fluid continues on to the tank battery while at least a small part of the water is separated at 28 and returned at 32.

After a time lapse of twenty hours, measuring means 66 indicate that the added inhibitor has arrived at flow lines 18 and 26. A time interval of twenty hours is considered a bit excessive for the above circuitous route of treatment chemical, so the flow rate at 40 is increased to that amount required to reduce this time to approximately 6 to 12 hours. Since a change has been effective in the system, the recording instrument 66 will acknowledge this change in flow rate approximately six to twelve hours later on.

Instrument 70 is observed, and it is found that the instantaneous corrosion rate of the recycled water is of a value seen at 96 in FIG. 3. The flow rate of the positive displacement pump 48 is slightly increased to increase the weight percent of the inhibitor chemical added to the system back down the curve towards numeral 94, thereby providing the borehole with controlled corrosion.

In the above example, the amount of injected inhibitor has been vastly reduced while concurrently the protection of the well has been increased tremendously. The savings in the cost of the chemical is significant, and the savings in the cost of well maintenance is tremendous. As in the above hypothetical example, there are many marginal wells undergoing water flooding which can be changed into a profitable producer by employment of the present invention.

In the above example, the treatment truck contained an extraneous water supply. This foreign water introduces still another source of corrosion into the system, as well as other possible undesirable variables. By recycling part of the separated well water back into the borehole, there is no foreign material added to the well other than the treatment chemical.

Most corrosion inhibitors can be admixed with water so that the inhibitor mixture does not separate or fall out during a time interval of 6–8 hours. After eight hours has lapsed, appreciable separation of the inhibitor and water occurs. Since the inhibitor-water mixture at 82 is heavier than the annular column of hydrocarbons at 86, the mixture gravitates down through the fluid column towards the heavier formation fluid 84, which often is 90% water and 10% hydrocarbons. As the mixture descends through the hydrostatic head, there will be some disbursement of inhibitor from the mixture into the hydrocarbons 86, because the inhibitor preferentially migrates from the water mixture into the hydrocarbon phase. This slight disbursement of chemical continually and uniformly coats the exterior of the production tubing and the interior of the casing well.

If an insufficient flow rate of the mixture is provided at 24, a preponderance of the inhibitor will leave the mixture and become admixed with the hydrocarbons at 86 so that insufficient inhibitor arrives downhole at the perforations. In this situation, the inhibitor continually accumulates at 86 and corrosion protection of the system is not maximized. Hence, it is important that a sufficient mass flow be maintained at 24 so that the mixture at 82 descends through the hydrostatic head where it can be utilized in chemically coating all of the downhole components of the well. This translocation of the mixture must occur within the time frame that the water-inhibitor remains mixed together.

As the well is produced, inhibitor flows down the fluid column to the perforations where the mixture comingles with the formation fluid and treats the downhole pump, the interior of the tubing, the flow lines 18 and 26, the separator 28, as well as the flow line 30 leading back to the tank battery. Accordingly, the present invention provides the desirable function of continuous treatment for the entire system. The effectiveness of the treatment is ascertained by the corrosometer 64. This is a long term absolute test which assures that the entire system has been properly treated and that the corrosion is being controlled over an extended time period of suitable duration.

Instrument 66 is a device for measuring conductivity. It can be any instrument which measures a change in chemical composition of the downhole fluid so as to provide an indication related to arrival of treatment chemical at the surface of the ground, thereby measuring the time interval required for the inhibitor to flow from pump 40 to the bottom of the wellbore and back up to the surface of the ground.

Numeral 28 can be any knockout drum that separates part of the water from the crude. Apparatus 50 can be eliminated and the invention practiced with the inhibitor 48 alone if desired.

Numeral 70 is an instrument which measures the instantaneous corrosion rate and is used to control the rate of delivery of the pump 40. Numeral 40 can be any type pump which moves a sufficient quantity of the water and inhibitor through the system, so long as provisions are made to intimately mix the water and inhibitor together, so that the mixture survives for the stated 6–8 hour duration. The rate of chemical inhibitor flow is controlled by the positive displacement pump at 48 in proportion to the reading obtained at 70, and the chemical is subsequently disbursed into the flow line 38. The flow of recycle water is measured at 68 and controlled by mixing pump 40 at a rate wherein the chemical will not breakout of the water and float on top of the oil, but instead will gravitate downhole to the perforations so that the lower annulus is treated. The mixture therefore must be forced to flow around through the system at a rate which is less than the time required for the chemical to break out of the water. The larger the hydrostatic head, the more difficulty is encountered in order to attain this desirable goal. Therefore, where the hydrostatic head is considerable, the flow rate of the water component of the mixture must be increased at 40 while holding the exact required amount of inhibitor at 48 to that amount required to control corrosion downhole in a borehole. In ordinary circumstances, five barrels of separated water at 68 and one gallon of inhibitor chemical at 48 is adequate to provide a mixture at 24 so as to attain protection against corrosion in accordance with the present invention.

Other treatment chemicals desired by the well operator can be added at 50 along with the mixture if deemed desirable.

In another example, a well is producing 200 barrels of fluid per day in a water flood area. The production fluid is 70% water cut. In the past, it had been found necessary to pull the pump and tubing about every 60 days at a cost of about $30,000.00.

In this situation, the invention according to FIG. 2 may be permanently applied to the well, with all of the instruments at 35 being enclosed within a small dog house. Where a downhole hydraulically actuated pump or a pump jack apparatus is employed for producing the well, an electrical supply will be available for a source of energy for the components of the present invention. Consultation of the well history indicates a hydrostatic head of eleven hundred feet, which represents several hundred barrels of fluid.

1.5 gallons of inhibitor was injected into 6 barrels of recycled water, and the mixture was continuously metered into the annulus over a 24 hour period. Four hours after the treatment commenced, an indication was received at 66 that residual inhibitor had been returned to the surface, therefore, the recycled water rate was reduced to 4 barrels per day, so as to move the time cycle towards 6 hours, and thereby reduce the load on the equipment. The instantaneous corrosion rate at 70 indicated that the proper amount of chemical was being injected. The well was left in this hypothetical configuration.

In instances such as exemplified above, the savings in maintenance and in chemical costs is enormous when compared to the known prior art methods of inhibiting a well against corrosion.

One example of a commercially available positive displacement pump which can advantageously be used at 48 and 50 is a Hydromyte (Reg- T.M.) metering pump, model HM-1, which strokes 30 spm to deliver 0.27 gph. This pump is marketed by Hydroflo Corporation, 112 Maple Avenue, Dublin, Pa. 18917, and described in Bulletin 395-2.

One example of a commercially available gear-type pump which can advantageously be used in the mixing pump 40 is Tuthill Magnetic Gear Pumps, described in Catalog Section 100, Model 9012, page 6, which has a capacity of 37 gph with pressures up to 80 psi; 2935 Kerner Boulevard, San Rafael, Calif. 94901.

Measuring device 66 is a Fincher Film Probe; available from Fincher Products, Houston, Tex.

Measuring device 70 is a Petralite P.A.I.R. Probe, available from Petralite Instruments, Houston, Tex.

Measuring device 64 is a Crossometer probe, available from Magna Instruments, Santa Fe Springs, Calif.

The chemical at 52 is a scale inhibitor, such as SP 181, for example, marketed by Treat-O-Lite.

The chemical at 54 is a corrosion inhibitor, such as Cortron 151, for example, marketed by Champion Chemical Co., Odessa, Tex. The chemical 54 is any substance which can be admixed with water to provide a temporary mixture which separates over the time interval required for it to fall through the hydrostatic head where the chemical is available to treat the bottom of the borehole and provide a continuous protection for the pump and piping.

I claim:

1. In a wellbore which produces a corrosive fluid through a production tubing, the method of controlling downhole corrosion comprising the steps of:

(1) mixing a corrosion inhibitor with recycled water to provide a mixture which remains admixed for a measured length of time;

(2) flowing the mixture downhole into the wellbore annulus;

(3) recycling at least part of the water by separating the produced comingled oil and water to provide the recycled water of step (1);

(4) measuring the time required for the inhibitor of step (1) to be returned from the well as residual inhibitor in the recycled water of step (3);

(5) measuring the corrosion rate of the separated water;

(6) adjusting the water rate of flow until the time interval of step (4) is less than the time interval found in step (1);

(7) adjusting the inhibitor rate of flow until step (5) indicates that the corrosion rate of the well is controlled.

2. The method of claim 1 wherein the treatment chemical and the water are mixed together sufficiently so that appreciable separation thereof requires 6–8 hours, and the flow rate of the water in the mixture is increased to cause the residual treatment chemical to flow through the borehole is less than 6–8 hours.

3. The method of claim 1 wherein the inhibitor is selected from the groups comprised of:

oil soluble filming inhibitors and water soluble filming inhibitors; and, the treatment chemical and the water are mixed together sufficiently so that appreciable separation thereof requires 6–8 hours, and the flow rate of the water in the mixture is increased to cause the residual treatment chemical to flow through the borehole in less than 6–8 hours.

4. In an oil well which produces hydrocarbons and water, and wherein the lower borehole annulus has a hydrostatic head comprised of a mixture of water and hydrocarbons adjacent the pay zone and separated hydrocarbons at a location above the water and hydrocarbon mixture, the method of treating the wellbore with treatment chemical comprising the steps of:

(1) flowing produced fluid from the well and separating at least part of the water from the produced fluid;

(2) admixing treatment chemical with the separated water of step (1) to provide an intimate mixture of produced water and treatment chemical;

(3) continuously flowing the mixture of step (2) into the borehole annulus and gravitating the mixture down through the separated hydrocarbon part of the fluid column contained within the annulus at a rate which causes most of the treatment chemical to arrive at the water and hydrocarbon mixture of the lower borehole.

5. The method of claim 4, and further including the steps of:

(4) measuring the time interval required for the mixture of treatment chemical and water to separate into water and treatment chemical;

(5) measuring the conductivity of the produced fluid; and, (6) adjusting the flow rate of the separated water in step (2) to obtain a mass flow of sufficient value to enable the mixture to gravitate down the annulus and into the production tubing prior to the treatment chemical separating from the water.

6. The method of claim 4, and further including the step of:

(4) measuring the corrosion rate of the separated water; and, (5) adjusting the flow rate of the treatment chemical used in step (2) to provide sufficient treatment chemical to substantially reduce the corrosion occurring downhole in the borehole.

7. The method of claim 6, and further including the step of:

(6) measuring the conductivity of the produced fluid before and after carrying out step (5); and, (7) adjusting the flow rate of the separated water in step (2) to obtain a mass flow of sufficient value to enable the mixture to gravitate down the annulus and into the production tubing prior to the treatment chemical separating from the water.

8. The method of claim 4 wherein the separated water flow rate and the treatment chemical flow rate is adjusted according to the following additional steps:

(4) measuring the conductivity of the produced fluid to determine the time interval required for the mixture to reach the tubing interior;

(5) adjusting the flow rate of the separated water in step (2) to obtain a mass flow of the mixture which enables the mixture to gravitate down the annulus and into the production tubing prior to the treatment chemical and water separating from one another;

(6) measuring the corrosion rate of the separated water; and, (7) adjusting the flow rate of the treatment chemical used in step (2) to provide sufficient treatment chemical to substantially reduce the corrosion occurring downhole in the borehole.

9. The method of claim 4 wherein the separated water and treatment chemical are admixed according to the following steps:

(4) flowing the water at a rate which translocates the chemical from the top of the annular fluid column down through the separated hydrocarbons within an interval of time which is less than the length of time required for the treatment chemical of the mixture to significantly disperse into the separated hydrocarbons contained within the upper annular area of the wellbore; and, (5) flowing the treatment chemical at a rate which controls the downhole corrosion rate.

10. Apparatus for treating oil wells with corrosion inhibitor chemical, comprising:

a separator, means for measuring the conductivity of produced fluid, means for measuring the corrosion rate of produced water, a mixing means by which water and treatment chemicals are admixed together to provide an intimate mixture of chemical and separated well water;

means connecting said separator to the well head for separating produced hydrocarbons from at least part of the produced water; a source of inhibiting chemical;

means connecting said separated water to said mixing means;

means connecting said source of inhibitor chemical to said mixing means; and means connecting said mixing means to the upper annular area of the oil well;

means controlling the rate of chemical flow in proportion to the corrosion measurement of the produced fluid to thereby provide a concentration of inhibitor chemical in the well which effectively controls the corrosion rate downhole in the borehole; and, means controlling the rate of flow of water through the mixing means proportional to the conductivity measurement so that a mass flow rate of mixed chemical and water is supplied to the annulus in an amount to force the mixture down through the hydrostatic head of the wellbore during a time interval which is less than the time interval required for most of the chemical to separate from the water of the mixture.

11. The apparatus of claim 10 wherein said corrosion inhibitor chemical is selected from the group consisting of;

oil soluble filming inhibitors and water soluble filming inhibitors.

12. The apparatus of claim 10 wherein said mixing means and the means for controlling the flow through the mixing means is a motor driven pump apparatus.

13. In a wellbore which produces hydrocarbons comingled with water up through a tubing string, with there being a lower borehole annulus containing a mixture of water and hydrocarbons, and an upper borehole annulus containing separated hydrocarbons, a process for controlling the corrosion rate of the borehole; comprising the steps of:

(1) producing the well and separating at least part of the water from the produced fluid;

(2) measuring a parameter of the produced fluid related to the presence of treatment chemical contained therein;

(3) measuring a parameter of the produced fluid related to the separated water;

(4) intimately admixing a quantity of treatment fluid with a quantity of the separated water and flowing the resultant mixture into the borehole annulus above the column of fluid contained within the wellbore annulus;

(5) using the measurement of step (3) to adjust the quantity of treatment fluid in step c4) to a value which controls the corrosion rate of the wellbore;

(6) using the measurement of step c2) to determine the length of time required for the mixture to travel through the fluid contained in the annulus; and, (7) adjusting the rate of flow of the quantity of water in step (4) to a value which causes the translocation of the mixture through the hydrocarbon part of the fluid column to occur before the mixture of water and treatment chemical separate to the extent which precludes corrosion control downhole in the borehole.

14. The method of claim 13 wherein the time interval required for the treatment chemical to travel from above the ground, downhole to the lower end of the borehole, and back to the surface of the earth is 4–8 hours.

15. The method of claim 13 wherein the treatment chemical and the water are mixed together sufficiently so that appreciable separation thereof requires 6–8 hours, and, the flow rate of the water in the mixture is increased to cause the treatment chemical to flow into the borehole, and back up to the surface of the ground in less than 6–8 hours.

16. The method of claim 13 wherein the residual inhibitor is measured by analyzing the separated water.

17. The method of claim 10 wherein the inhibitor is selected from the group comprised of:

oil soluble filming inhibitors and water soluble filming inhibitors; and, the treatment chemical and the water are mixed together sufficiently so that appreciable separation thereof requires 6–8 hours, and, the flow rate of the water in the mixture is increased to cause the residual treatment chemical to flow through the borehole and back up to the surface of the ground in less than 6–8 hours.

* * * * *